United States Patent [19]

Zumbrunn

[11] 4,167,241

[45] Sep. 11, 1979

[54] LETTER ENVELOPE AND DISPLAY

[76] Inventor: Robert Zumbrunn, Brunnenwiese 35, 8610 Uster, Switzerland

[21] Appl. No.: 832,579

[22] Filed: Sep. 12, 1977

[51] Int. Cl.[2] ..... B42D 15/04; G09F 1/12

[52] U.S. Cl. ..... 229/928; 40/152.1

[58] Field of Search ..... 229/92.8; 40/152.1, 40/124.1

[56] References Cited

U.S. PATENT DOCUMENTS

| | | | |
|---|---|---|---|
| 1,038,652 | 9/1912 | Reese | 229/92.8 |
| 2,219,492 | 10/1940 | Prichap | 40/152.1 |
| 3,174,244 | 3/1965 | Walton | 40/124.1 |
| 3,355,828 | 12/1967 | Betz | 40/152.1 |
| 3,503,835 | 3/1970 | Hermann | 40/125 A |
| 3,545,115 | 12/1970 | Nichols | 40/152.1 |

FOREIGN PATENT DOCUMENTS

| | | | |
|---|---|---|---|
| 144507 | 8/1916 | Fed. Rep. of Germany | 229/92.8 |
| 347370 | 3/1905 | France | 229/92.8 |
| 13871 | of 1903 | United Kingdom | 229/92.8 |
| 10286 | of 1908 | United Kingdom | 229/92.8 |
| 661432 | 11/1951 | United Kingdom | 40/152.1 |

*Primary Examiner*—Stephen P. Garbe

*Attorney, Agent, or Firm*—Wenderoth, Lind & Ponack

[57] ABSTRACT

A combined letter envelope and display frame device for mailing and dispensing photographs includes a single piece of light cardboard or paper material folded into at least two panels. A first of the panels has on one side thereof adhesive strips for attachment thereto of a photograph to be mailed and displayed, and also for attachment thereto of one side of a second of the panels which is adapted to be folded over the one side of the first panel, thereby enclosing the photograph within the panels and forming a letter envelope. The second panel has therein an integral window portion defined by perforations which extend through the second panel, such that the window portion may be selectively manually removed along the perforations, thereby forming a display window for display of the photograph. One of the panels forms a back cover of the device and has therein a selectively manually movable supporting leg for supporting the device when it is employed as a display frame. The supporting leg is defined by a pair of lines of perforations which extend through such one panel. On the outer side of the back cover there is printed mailing indicia for the receipt of the mailing address of the intended recipient of the letter envelope.

7 Claims, 5 Drawing Figures

LETTER ENVELOPE AND DISPLAY

BACKGROUND OF THE INVENTION

The present invention relates to a combined letter envelope and display device, its application and use.

As is commonly known, the recipient of photographic pictures only on rare occasions has readily available means to display such pictures, even only temporarily, in an appropriate manner.

SUMMARY OF THE INVENTION

The present invention provides a special letter envelope which can be transformed in a simple manner into a photoframe which can be displayed.

The letter envelope includes at least two folding portions, at least one such portion having means for fixing thereto a photograph. At least one other portion forms an outside cover of the letter envelope and is constructed in such a way that a central portion thereof can be removed by hand to produce an opening which displays the photograph, which has been fixed between the two folding portions. A portion of the letter envelope forms the other outside cover or the back cover of the envelope and has a section which can be pulled out by hand to produce a supporting leg to support the envelope which is now used as a display device.

It is an advantageous part of this invention that the removable central portion of the letter envelope can be used on the inside thereof to provide written information to the recipient of the letter envelope.

For certain purposes it is advantageous that this letter envelope includes at least three folding portions, two of which are used to form the two outside covers, and the third of which is used to hold the photograph placed between the two portions forming the outside covers.

It is advantageous that the supporting leg that folds out from one cover is made in such a way as to receive the complete address of the recipient.

It is advantageous if the removable central portion of the other cover is provided with an appropriate perforated line, such as to facilitate easy removal.

A concept of this invention is that the letter envelope can be used as a photo display frame.

BRIEF DESCRIPTION OF THE DRAWINGS

This invention will further be explained in the following detailed description, taken with the accompanying drawings, wherein.

DETAILED DESCRIPTION OF THE INVENTION

Figure 1:
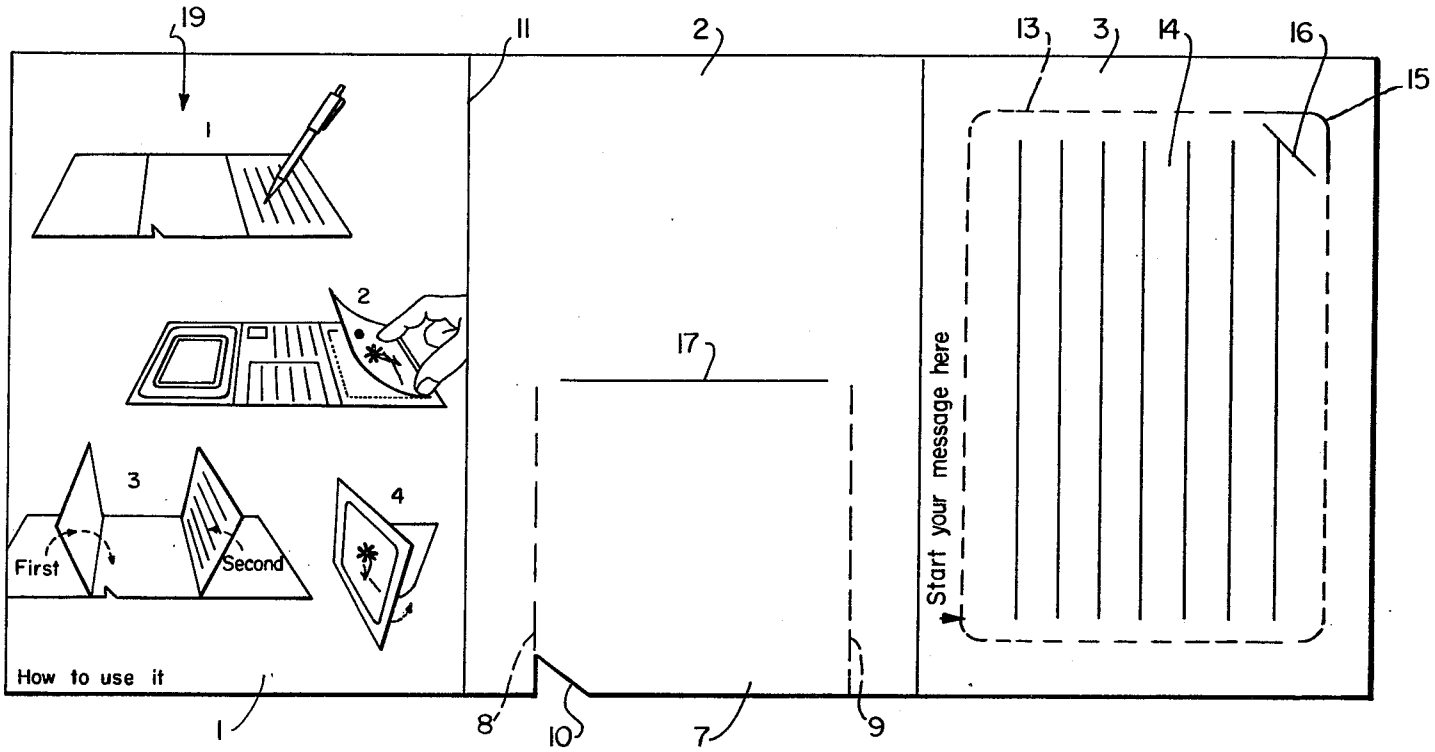
FIG. 1 is a view of one side of a letter envelope in the folded out form according to one embodiment of the invention.

The embodiment of the letter envelope shown in FIGS. 1 through 4 includes three joined folding panels or portions 1, 2 and 3. The first panel or portion 1 is used to fix the photograph 4 to be sent to the recipient. Self adhesive tape strips 5 and 6 are placed on the outer side of portion 1 and are initially covered with respective protecting tapes, which can be removed to allow attachment of a photograph to portions of the self adhesive tapes 5 and 6, to thereby fix the photograph.

The second or middle panel or portion 2 forms one of the two outside covers of the letter envelope and contains a supporting leg 7 which can be folded out by hand to display the envelope in an upright manner. Supporting leg 7 is constructed in such a fashion as to allow the partial separation thereof from the plain or the main part of the middle portion 2. That is, the sides of supporting leg 7 are manually separable along perforated lines 8 and 9, but supporting leg 7 remains connected with the remaining part of the middle portion 2 along bending line 17.

The provision of sloping edge 10 of part of the supporting leg 7 simplifies the understanding of instructions for use of the envelope.

After the photograph 4 has been fixed to portions of the self adhesive tapes 5 and 6 on the first portion 1, portion 1 of the letter envelope is folded along line 11 over portion 2 in such a way that the photograph 4 rests on the side of portion 1 which is turning away from the middle portion 2.

Following this step, the third panel or portion 3 is folded over portion 1 in such a way that the photograph 4 fixed to portion 1 is completely covered by portion 3. Portion 3 is connected with portion 1 by those portions of the self adhesive tapes 5 and 6 which have not been covered by the photograph 4.

The third portion 3 is constructed in such a way that the photograph 4 which is fixed between portion 3 and portion 1 can be seen through a window 12 which can be opened manually by removing an inner portion 14 of portion 3 along a perforated line 13. Inner portion 14 will be removed by the recipient of the letter envelope.

To facilitate the removal of inner portion 14 with a fingernail, the paper of portion 14 is provided with a cut along one corner edge 15 of the perforated line 13, and the resultant corner can be folded out along fold edge 16.

The manually removable inner portion 14 has been printed with lines as shown in FIG. 1, in order to facilitate the writing of a message to the recipient. This message can be read after removal of inner portion 14 to display the photograph 4.

The recipient of the letter envelope can then pull out supporting leg 7 along the perforated lines 8 and 9 from the remainder of back cover portion 2 and bend it along line 17 in such a way that a perfect photo display device is formed.

Figure 2:
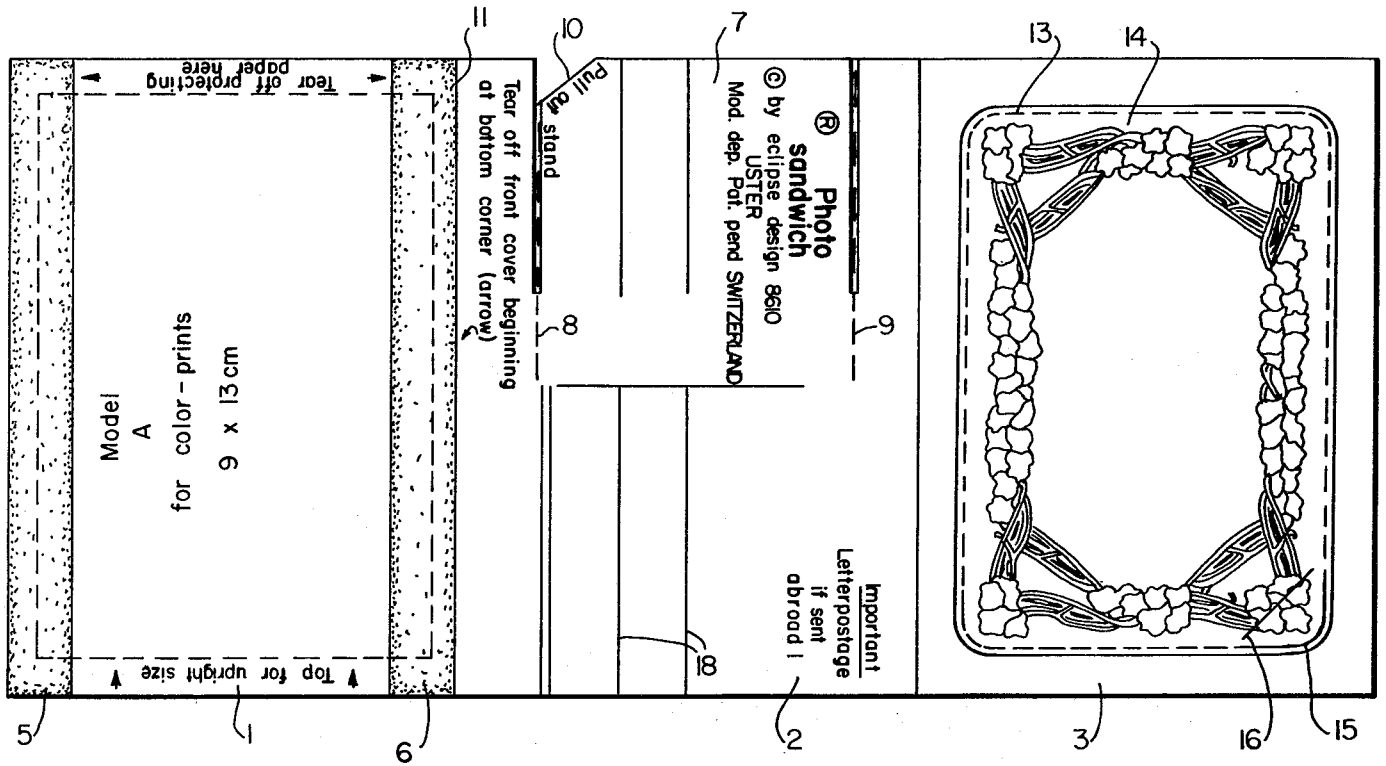
FIG. 2 is a view of the opposite side of the letter envelope shown in FIG. 1.
Figure 3:
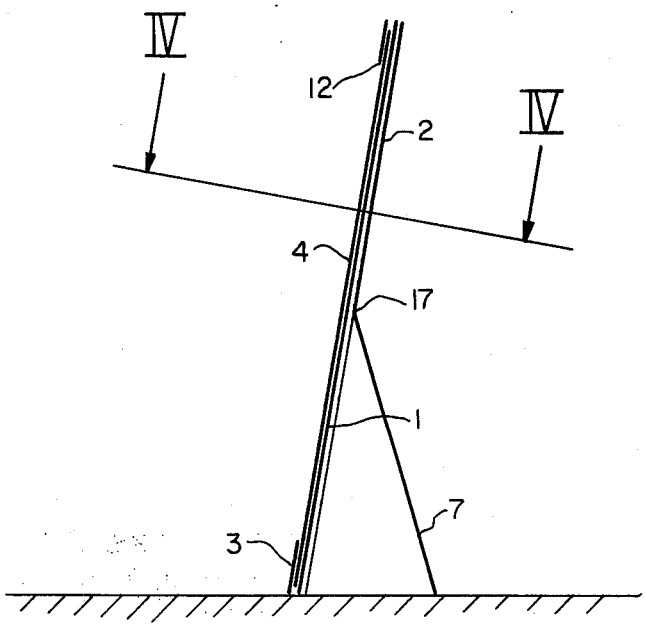
FIG. 3 is a sectional view, taken along line III—III of FIG. 4, of the letter envelope in FIG. 1 and FIG. 2, in the photo display frame position thereof.
Figure 4:
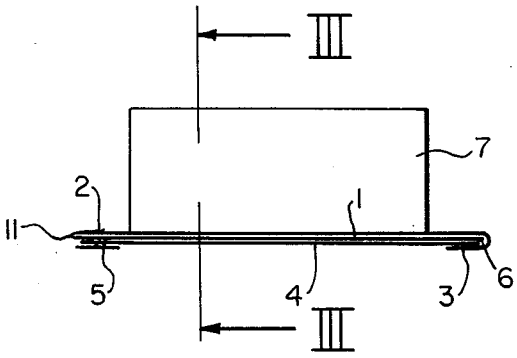
FIG. 4 is a sectional view, taken along line IV—IV of FIG. 3.

As shown in FIG. 2, the supporting leg 7, on the outer side of back cover portion 2 has been printed with lines to facilitate the writing of the address of the recipient.

The first portion 1 has been printed on the inside thereof with instructions 19 for the proper application and fixture of the photograph 4 and the proper folding of the envelope.

It is also possible, instead of using two self adhesive tapes 5 and 6, to employ only the tape 6, which will operate to satisfactorily seal the outside edge of portion 3.

Figure 5:
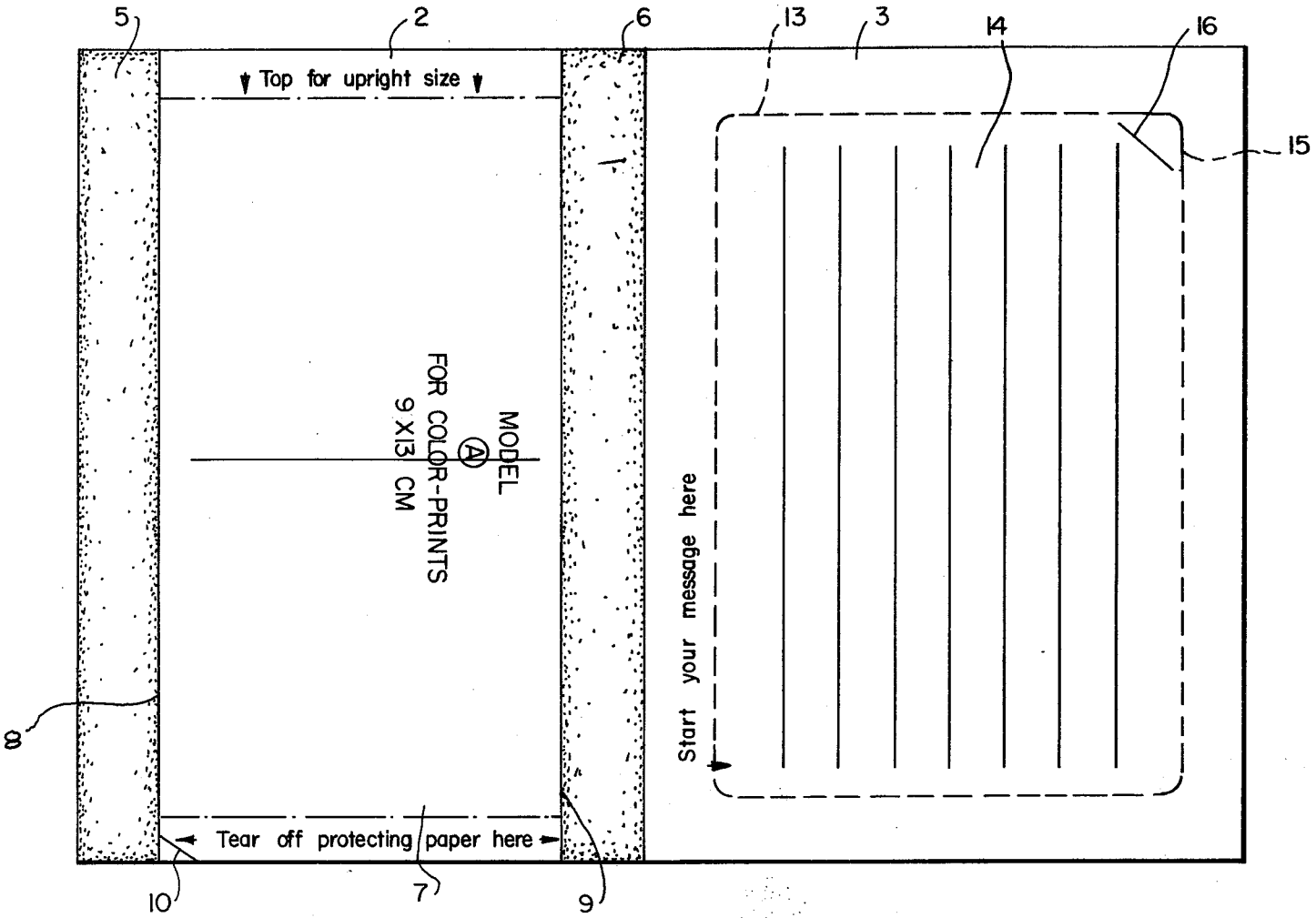
FIG. 5 is a view of one side of a letter envelope in the folded out form according to a second embodiment of the invention.

A second embodiment of the invention, shown in FIG. 5, differs from the embodiment shown in FIGS. 1 to 4 only in the fact that the envelope is formed with only two panels or portions, instead of three portions. In this case the self adhesive tapes 5 and 6 which hold the photograph 4 are attached directly to part 2, which also includes the supporting leg 7.

Since all other items of this embodiment are identical to those in the embodiment of FIGS. 1 to 4, a further discussion thereof is not necessary herein.

The embodiment shown in FIG. 5, which consists of two connected panels or portions 2 and 3, could also be made from two portions 2 and 3 which are totally separated from each other. Such two portions would then be fixed to each other only after the photograph had been attached to portion 2.

The self adhesive tapes holding the picture would also hold the two portions together.

The embodiments of the invention in which an exclusive property or privilege is claimed are defined as follows:

I. Letter envelope comprising of a minimum of two folding portions (1,2,3) of which at least one portion (2) is needed to attach the photographic picture (4) and the other (3), forming one outside cover of the envelope, has a window (12) to display the picture (4) placed between portion (2) and (3). This window (12) is formed by manually removing the inner section (14). From the back cover (12) of the envelope a section (7) can be pulled out and bent manually to from the supporting leg.

II. Application of said letter envelope according to claim I as photodisplay device.

I claim:

1. A combined letter envelope and display frame device for mailing and displaying articles such as photographs, said device comprising:

a single piece of light cardboard or paper material folded into at least two panels;

a first of said panels having on one side thereof adhesive means for attachment thereto of an article to be mailed and displayed and for attachment thereto of one side of a second of said panels adapted to be folded over said one side of said first panel, thereby enclosing said article within said panels and forming a letter envelope;

said second panel forming a front cover of said device and having therein an integral window portion defined by perforations extending through said second panel, such that said window portion may be selectively manually removed along said perforations, thereby displaying said article attached to said one side of said first panel, after said device has been received in the mail by an intended recipient;

one of said panels forming a back cover of said device and having therein a selectively manually movable supporting leg for supporting said device when employed as a display frame, said supporting leg being defined by a pair of lines of perforations extending through said one panel; and said back cover having an outer side having printed thereon mailing indicia for the receipt of the mailing address of the intended recipient of the letter envelope.

2. A device as claimed in claim 1, wherein said single piece of material includes three folded panels including an intermediate panel forming said back cover.

3. A device as claimed in claim 1, wherein said single piece of material includes two folded panels, said first panel having a second side having said mailing indicia printed thereon.

4. A device as claimed in claim 1, wherein the inner side of said window portion of said second panel has printed thereon indicia means for aiding the sender of the device in writing a message to the recipient of the device.

5. A device as claimed in claim 1, wherein said window portion has a corner which is defined by a single cut extending completely through said second panel, thereby providing means for facilitating the removal of said window portion by the recipient of the device.

6. A device as claimed in claim 1, wherein said mailing indicia is printed on the outer side of said supporting leg.

7. A device as claimed in claim 1, wherein a portion of said one panel which forms said supporting leg is cut away at a position adjacent one of said lines of perforations, thereby forming means facilitating manual movement of said supporting leg.

* * * * *